United States Patent [19]

Sato et al.

[11] Patent Number: 4,911,084

[45] Date of Patent: Mar. 27, 1990

[54] PALLET

[75] Inventors: Yoshiharu Sato, Tokyo; Toshio Watanabe, Nagareyama, both of Japan

[73] Assignee: Canon Kabushiki Kaisha, Tokyo, Japan

[21] Appl. No.: 228,445

[22] Filed: Aug. 5, 1988

[30] Foreign Application Priority Data

Aug. 10, 1987 [JP] Japan ..... 62-121485[U]

[51] Int. Cl.[4] ..... B65D 19/00; B65D 19/44

[52] U.S. Cl. ..... 108/51.1; 108/55.1; 108/55.3

[58] Field of Search ..... 108/55.1, 53.3, 55.3, 108/56.3, 51.1

[56] References Cited

U.S. PATENT DOCUMENTS

| | | | |
|---|---|---|---|
| 2,471,693 | 5/1949 | Lilienfeld | 108/55.1 |
| 2,529,752 | 11/1950 | Whittle | 108/55.1 |
| 2,828,040 | 3/1958 | Fitton et al. | 108/55.1 |
| 2,936,985 | 5/1960 | Doerr et al. | 108/55.1 |
| 3,620,388 | 11/1971 | Mansson | 108/55.1 |
| 3,753,407 | 8/1973 | Tilseth | 108/55.3 |
| 4,013,020 | 3/1977 | Schoeller et al. | 108/55.3 |
| 4,079,907 | 3/1978 | Mykleby | 108/55.1 |
| 4,717,025 | 1/1988 | Maurer | 108/55.5 |

FOREIGN PATENT DOCUMENTS

| | | | |
|---|---|---|---|
| 2216053 | 7/1973 | Fed. Rep. of Germany | 108/55.3 |
| 46-010440 | 4/1971 | Japan . | |
| 49-023403 | 6/1974 | Japan . | |
| 50-021252 | 6/1975 | Japan . | |
| 50-022443 | 7/1975 | Japan . | |
| 50-042526 | 12/1975 | Japan . | |

*Primary Examiner*—Francis K. Zugel

*Attorney, Agent, or Firm*—Fitzpatrick, Cella, Harper & Scinto

[57] ABSTRACT

A pallet has slope plates provided on a base plate supporting an article thereon for forming a slope when the article is unloaded from the pallet.

2 Claims, 3 Drawing Sheets

PALLET

BACKGROUND OF THE INVENTION

1. Field of the invention

This invention relates to a pallet for supporting a product, parts or the like thereon for transportation.

2. Related Background Art

When an article of great volume and heavy weight, for example, a business machine such as a copying apparatus, is to be conveyed from an assembly factory or the like to another place by a forklift, the article is placed on a pallet and the pallet is bodily conveyed by the forklift. As a pallet for conveyance, the technique of mounting a leg member under a plate member, forming a space for inserting a forklift therethrough between the ground and the plate member, placing an article on the plate member and transporting the article is known from Japanese Utility Model Publication (examined) No. 49-23403, Japanese Utility Model Publication (examined) No. 50-21252, Japanese Utility Model Publication (examined) No. 50-22443, etc. The bulky article such as the aforementioned copying apparatus, because of its great volume and weight, requires much labor and time for loading and unloading it onto and from a pallet and it is necessary to reduce the cost in commodity distribution control. For the loading and unloading of an article onto and from a pallet, use is made of the supporting pass plate shown in Japanese Utility Model Publication (examined) No. 46-10440. This pass plate is such that it is bendably connected at the central portion of the body thereof by means of a pin hinge, rubber wheels are attached to the opposite sides of the rear of the bent portion, handles are attached to the opposite sides of the rear of the pass plate, and during the use, the fold is stretched and a pallet is passed over two high and low locations to thereby transport an article. Further, a pallet in which on a supporting bed body provided with an inclined surface, a supporting plate inclined along said inclined surface is mounted by means of a hinge is known from Japanese Utility Model Publication (examined) No. 50-42526.

The prior-art article supporting pallet is contrived so as to withstand the weight of the article, but it requires the aforedescribed pass plate or the like to be used to load the article onto the pallet and unload the article from the pallet.

Business machines, particularly business machines of large size and great volume such as copying apparatuses, manufactured in a factory are carried one by one on individual pallets when they are distributed from the factory to agents or from the factory to commodity distribution control centers and final customers. In that case, much labor and time are required for placing the business machines onto the pallets and it is difficult to reduce the cost of commodity distribution control. Also, in that case, it is cumbersome to prepare the aforementioned pass plate separately and bring it out and mount it each time a business machine is loaded and unloaded.

There is also the problem that unless a necessary number of pass plates are prepared in the place for loading and unloading of business machines onto and from the pallets, time is wastefully consumed for the distribution work.

As described above, the prior-art article supporting pallet has not been provided with means for unloading an article from the pallet and therefore, if the weight or volume of the article supported thereon is great, it has given rise to the necessity of using an instrument such as a forklift or lifting the article by several workers when the article is unloaded from the pallet. Also, it has often been the case that when corner pads are to be removed or when the article is to be unloaded, the corner potions of the pallet contacts with the bottom of the particle to thereby damage the article.

SUMMARY OF THE INVENTION

It is an object of the present invention to provide a pallet provided with slope plates for loading and unloading an article when the article is to be loaded onto and unloaded from the pallet, thereby eliminating the above-noted inconveniences.

It is another object of the present invention to provide a pallet provided with corner pads serving also as wheel fixing members for fixing wheels to the pallet when an article provided with casters or wheels, such as a business machine, is transported on the pallet, thereby preventing any positional deviation of the corner portions of the article and the article on the pallet.

It is still another object of the present invention to provide a pallet provided with corner pads and slope plates and wherein the corner pads on the pallet are fixed by the slope plates, thereby preventing movement of the corner pads on the pallet.

DESCRIPTION OF THE PREFERRED EMBODIMENT

Figure 1:
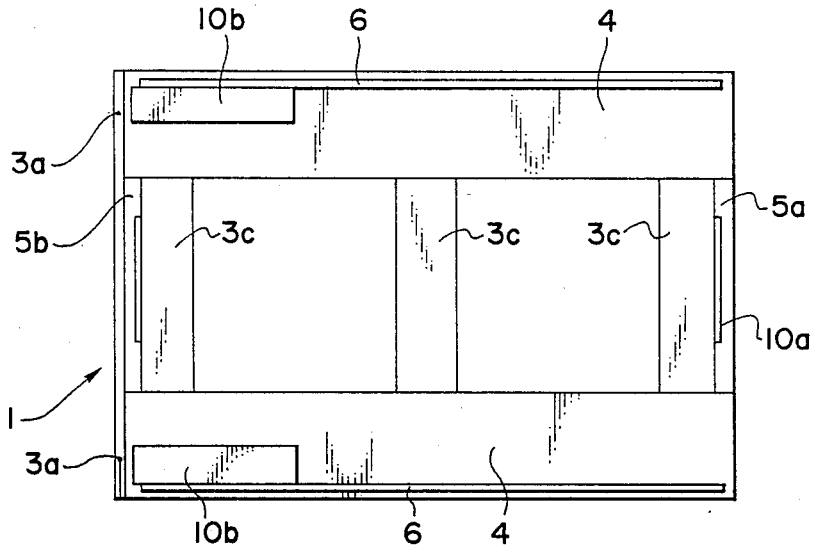
FIG. 1 is a plan view of an embodiment of a pallet bed according to the present invention.
Figure 2:
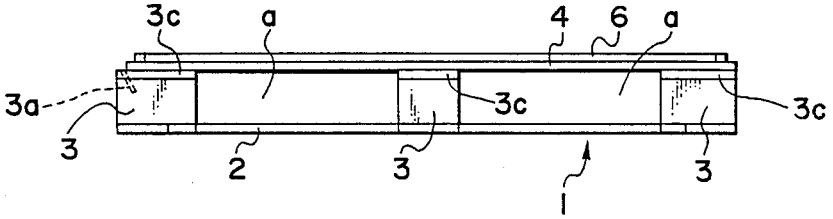
FIG. 2 is a side view of the pallet bed of FIG. 1.

The present invention will hereinafter be described with respect to an embodiment thereof with reference to the drawings. FIG. 1 is a plan view of an embodiment of a pallet according to the present invention, and FIG. 2 is a side view thereof. Referring to these figures, a pallet bed 1 comprises a plurality of plate members 3 secured on a base plate 2 at intervals and parallel to one another, and two supporting plates 4 secured on the plate members 3 at right angles thereto, with plates 3*c* interposed therebetween, at spaced intervals and parallel to each other. A space a into which the fork of a forklift is inserted is formed between the base plate 2 and the supporting plates 4. An elongate bar member 6 is fixed to the outer side of each supporting plate 4. Designated by 5*a* and 5*b* are plate members of the same thickness as the plates 4 mounted on the plates 3. A restraining plate 10*a* is fixed on the plate members 5*a* and 5*b*. Denoted by 10*b* is a restraining plate mounted on each supporting plate 4.

Figure 3:
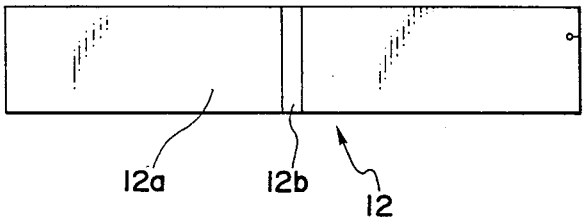
FIG. 3 is a plan view of an embodiment of a slope plate according to the present invention.
Figure 4:
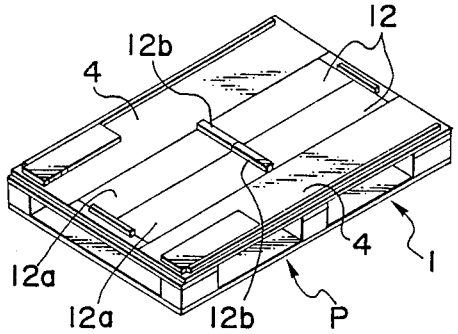
FIG. 4 is a perspective view of an embodiment of the pallet of the present invention in which slope plates are mounted on the pallet bed.

FIG. 3 shows a slope plate 12 which comprises a rectangular plate member 12*a* and a bend preventing member 12*b* secured widthwise across the upper surface of the lengthwisely central portion thereof. As shown in FIG. 4, a pair of such slope plates 12 are fitted between the supporting plates 4. In this case, the bend preventing members 12*b* are positioned on the upside. The upper surfaces of the supporting plates 4 and the slope plates 12 are on the same plane.

Figure 5:
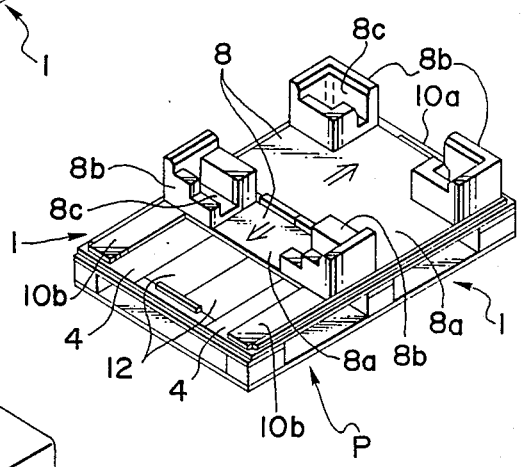
FIG. 5 is a perspective view of the pallet of the present invention in which corner pad holding members are mounted on the pallet of FIG. 4.

FIG. 5 is a perspective view showing the corner pad holding members 8 as they are mounted on the pallet bed 1 on which the slope plates 12 are placed. The corner pad holding members 8 each comprise a cardboard plate 8*a* and corner pads 8*b* mounted on the cardboard plate 8*a*, and the two cardboard plates 8*a* form one set, and a pair of corner pads 8*b* are mounted on each plate 8*a*.

The corner pad holding members 8, when placed on the slope plates 12, are restrained at the side edges thereof by the elongate bar members 6, the restraining member 10*a* and 10*b* and the bend preventing members 12*b*.

As described above, the pallet P of the present invention is comprised of the pallet bed 1, the slope plates 12 fitted therein, and the corner pad holding members 8 placed on the slope plates 12.

Figure 6:
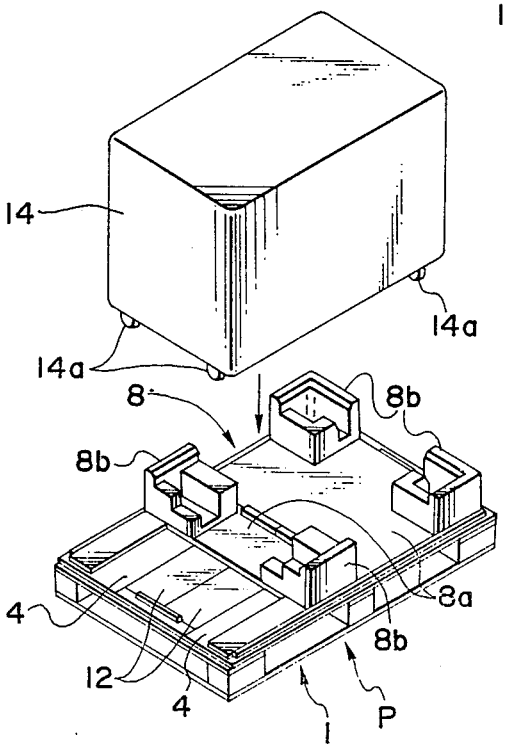
FIGS. 6, 7 and 8 are perspective views for illustrating the situation in which the present invention is used.
Figure 7:
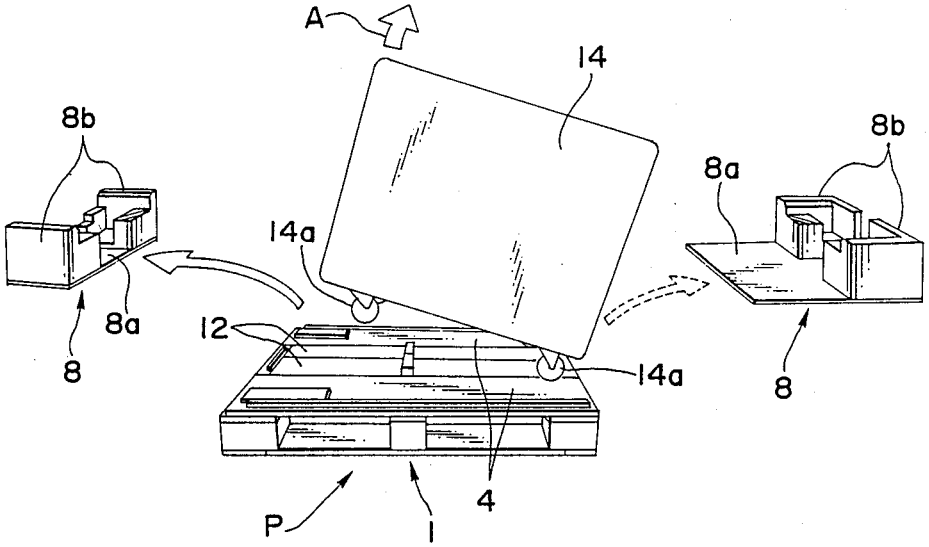

How the pallet P of the present invention is used will now be described with reference to FIGS. 6, 7 and 8. FIG. 6 shows an example in which an article is placed on the pallet of the present invention, and here, the slope plates 12 and the corner pad holding members 8 are mounted on the pallet bed 1. The casters 14*a* of an article 14 are restrained in holes 8*c* formed in the corner pads 8*b* of the corner pad holding members 8 and the article 14 is placed onto the pallet P, whereby the article 14 becomes transportable. When the article 14 is to be unloaded from the pallet P after the article 14 has been placed onto the pallet P and transported, one side edge of the article 14 is slightly lifted over the pallet P as indicated by arrow A in FIG. 7 and one corner pad holding member 8 is pulled out and the other corner pad holding member 8 is likewise pulled out, whereby the article 14 is left on the supporting plates 4 through the casters 14*a*, and the slope plates 12 are pulled out through the clearance at the bottom of the article 14.

Figure 8:
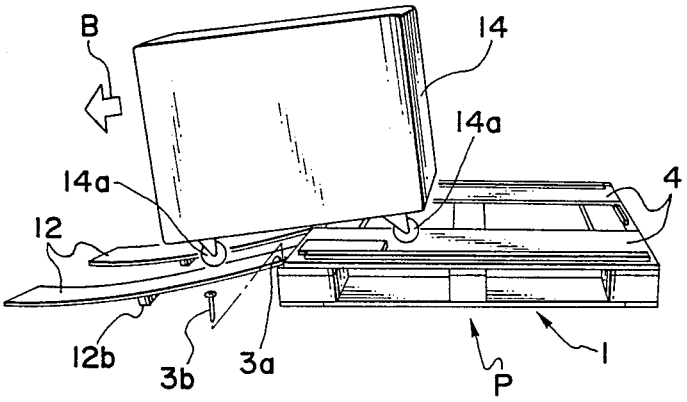

As shown in FIG. 8, the pulled-out slope plates 12 are restrained at one end thereof through restraining holes 3*a* (see FIGS. 1 and 2) formed in the plate members 3 of the pallet P and restraining pins 3*b*. At this time, the slope plates 12 are turned over to cause the bend preventing plates 12*b*of the slope plates 12 to face downward. Thus, each slope plate 12 forms a slope on the extension of each supporting plate 4 between the upper surface of the pallet P and the floor surface. The article 14 is then moved in the direction of arrow B and is moved from the supporting plates 4 onto the slope plates 12 by means of the casters 14*a*, and the article 14 is unloaded from the pallet P. When the load of the article 14 acts on the slope plates 12, the slope plates become bent, but such bending is suppressed by the bend preventing plates 12*b* provided on the slope plates 12, and the slope plates 12 maintain a suitable degree of slope to permit the article 14 to be smoothly unloaded.

As described above, according to the present invention, the corner pad holding members 8 are held on the slope plates 12 fitted in the pallet bed and are restrained on the slope plate bend preventing plates 12*b* and therefore cause no positional deviation, and the article 14 placed thereon does not move during transportation.

Also, the corner pad holding members 8 are divided into two by the slope plate bend preventing plates 12*b* and contained in the pallet and therefore, the corner pad holding members 8 can be pulled out from the opposite ends of the pallet, and when the carrier of the article is to be removed from the corner pads, the article need only be slightly inclined and the physical labor of the worker can be mitigated, and this is also preferable in respect of the safety of work.

Also, where the article placed on the pallet is to be unloaded from the pallet, the carrier of the article is positioned on the supporting plates 4 of the pallet after the corner pad holding members 8 are pulled out, and the slope plates are restrained on the extension of the supporting plates 4, whereby the article can be moved straight from the supporting plates onto the slope plates and therefore, no unreasonable force is required for the movement of the article and the article can be unloaded with a light load.

Heretofore, it has generally been practiced to make a pallet like that of the present invention of wood, and the pallet of the present invention can also be made of wood, but molded material such as plastics can also be used for the pallet of the present invention.

What is claimed is:

1. A pallet for mounting an article thereon, comprising:

a plurality of supporting plates arranged in parallel and spaced apart from each other;

a plurality of plate members fixed below and to said supporting plates and arranged substantially perpendicular thereto, said plate members being spaced apart from each other;

a slope plate detachably disposed between said supporting plates to mount said article on said pallet and positionable to form an incline to remove said article from said pallet, said slope plate having a bend preventing portion for reducing bend in said slope plate when the article is on the slope plate;

a restraining member attached to an end of each of said supporting plates; and first and second corner pad holding members detachably disposed on said supporting plates and said slope plate and restrained thereon by said bend preventing portion and the restraining members wherein the article is fixed by said corner pad to said pallet when the article is mounted on said pallet and a slope is formed by said slope plate when the article is removed from said pallet.

2. A pallet for mounting an article thereon, comprising:

a plurality of supporting plates arranged in parallel and spaced apart relation;

a plurality of plate members fixed to an underside portion of each said supporting plate, said plate members being arranged substantially perpendicular to said supporting plates and spaced apart from each other;

a bar member attached to each said supporting plate;

a slope plate detachably disposed between said supporting plates to mount said article on said pallet and positionable to form an incline to remove said article from said pallet, said slope plate having a bend preventing section for reducing bend in said slope plate when the article is being removed from the pallet; and first and second corner pad holding members each having a plurality of corner pads, said first and second corner pad holding members being detachably disposed on said supporting plates and said slope plate, said corner pad holding members being prevented from moving when disposed on said supporting plates and on said slope plate by said bend preventing section and said bar members.

* * * * *

UNITED STATES PATENT AND TRADEMARK OFFICE

CERTIFICATE OF CORRECTION

PATENT NO. : 4,911,084

DATED : March 27, 1990

INVENTOR(S) : Yoshiharu Sato, et al.

It is certified that error appears in the above-identified patent and that said Letters Patent is hereby corrected as shown below:

COLUMN 2:

Line 6, "potions" should read --portions--.

COLUMN 3:

Line 46, "12*b*of" should read --12*b* of--.

Signed and Sealed this

Tenth Day of September, 1991

*Attest:*

HARRY F. MANBECK, JR.

*Attesting Officer*

*Commissioner of Patents and Trademarks*